US005267687A

United States Patent [19]

Sherman

[11] Patent Number: 5,267,687

[45] Date of Patent: Dec. 7, 1993

[54] TWO WAY MAILER

[75] Inventor: Richard A. Sherman, Boylston, Mass.

[73] Assignee: Sheppard Envelope Company, Worcester, Mass.

[21] Appl. No.: 851,188

[22] Filed: Mar. 13, 1992

[51] Int. Cl.[5] ..... B65D 27/06

[52] U.S. Cl. ..... 229/305

[58] Field of Search ..... 229/304, 305

[56] References Cited

U.S. PATENT DOCUMENTS

| | | | |
|---|---|---|---|
| 769,536 | 9/1904 | Dixon . | |
| 1,324,100 | 12/1919 | Binkowitz . | |
| 1,960,054 | 5/1934 | Johnson . | |
| 2,289,460 | 7/1942 | Sacks . | |
| 2,686,005 | 8/1954 | Hyman . | |
| 2,759,658 | 8/1956 | Sawdon . | |
| 2,760,717 | 8/1956 | Wyatt . | |
| 2,872,099 | 2/1959 | Prial | 229/304 |
| 2,928,583 | 3/1960 | Law . | |
| 2,983,431 | 5/1961 | Turan . | |
| 2,984,403 | 5/1961 | David . | |
| 3,084,846 | 4/1963 | Clegg . | |
| 3,086,695 | 4/1963 | Lillibridge . | |
| 3,113,716 | 12/1963 | Howard . | |
| 3,152,751 | 10/1964 | Hiersteiner . | |
| 3,184,150 | 5/1965 | Hubbard . | |
| 3,558,040 | 1/1971 | Krueger . | |
| 3,652,007 | 3/1972 | MacDougall . | |
| 3,802,618 | 4/1974 | Wiessner . | |
| 4,308,987 | 1/1982 | Solomon . | |
| 4,487,360 | 12/1984 | Fisher et al. . | |
| 4,565,317 | 1/1986 | Kranz . | |
| 4,595,138 | 6/1986 | Kristel . | |
| 4,602,736 | 7/1986 | Barr . | |
| 4,688,715 | 8/1987 | Barr . | |
| 4,730,768 | 3/1988 | Gendron . | |
| 4,775,095 | 10/1988 | Emmott . | |
| 4,784,317 | 11/1988 | Chen et al. . | |
| 4,899,926 | 2/1990 | Spaulding . | |

FOREIGN PATENT DOCUMENTS

| | | |
|---|---|---|
| 784432 | 7/1935 | France . |
| 21278 | of 1892 | United Kingdom . |

*Primary Examiner*—Stephen P. Garbe

*Attorney, Agent, or Firm*—Samuels, Gauthier & Stevens

[57] ABSTRACT

A two way mailer is formed from a single blank of sheet material, and has separably interconnected forwarding and return envelopes sharing a common rear panel. The return envelope is separable from the forwarding envelope along panel and side flap perforated lines. The pane perforated line is located exclusively or substantially exclusively along the top edge of the rear panel. The side flap perforated lines are perpendicular to the panel perforated line and define side flaps extending outwardly from the side edges of the rear panel.

8 Claims, 12 Drawing Sheets

TWO WAY MAILER

DESCRIPTION OF THE INVENTION

1. Field of the Invention

This invention relates generally to envelopes, and is concerned in particular with a two way mailer comprising the separable combination of a forwarding envelope and a return envelope formed from a single blank of sheet material.

2. Description of the Prior Art

Two way mailers are already known, as evidenced, for example by the disclosure in U.S. Pat. No. 4,899,926 (Spaulding). An objective of the present invention is to further improve the state of the art by providing for a machine insertable and U.S. Postal Services approved machine mailable two way mailer which utilizes as little paper (or other material) as possible, yet still provides for a return envelope which is as close to the size of the forwarding envelope as possible.

This objective is achieved by utilizing a set of vulnerable side flaps which are separated from a common rear panel of the forwarding envelope and remain adhered to a front panel of the forwarding envelope when the forwarding envelope is opened. This unique feature allows for a seamless return envelope fabricated of a minimal quantity of sheet material.

Other prior art two way mailers are disclosed in U.S. Pat. Nos. 1,324,100 (Binkowitz); 3,184,150 (Hubbard); 3,652,007 (MacDougall); 3,802,618 (Wiessner); and UK 21,278, none of which disclose or suggest the use of anything resembling the side flaps of the present invention.

Prior art two way mailers with side flaps (or "tabs") are disclosed in U.S. Pat. Nos. 2,289,460 (Sacks); 2,686,005 (Hyman); 2,759,658 (Sawdon); 2,760,717 (Wyatt); 2,928,583 (Law); 2,983,431 (Turan); 2,984,403 (David); 3,086,695 (Lillibridge); 3,113,716 (Howard); 3,152,751 (Hiersteiner); 3,558,040 (Krueger); 4,308,987 (Solomon); 4,565,317 (Kranz); 4,595,138 (Kristel); 4,602,736 (Barr); 4,688,715 (Barr); 4,730,768 (Gendron); 4,775,095 (Emmott) and the above referenced '926 patent to Spaulding. However, none of these includes side flaps or the like which are removed or torn upon opening the forwarding envelope. As such, the side flaps remain connected to some portion or portions of the two way mailers. It is more efficient and more economical to have the side flaps disengage from the two way mailer when the flaps are no longer necessary, i.e., after the forwarding envelope has been opened. This is because less material is used yet the outer widths of the forwarding and return envelopes are essentially identical.

Prior art two way mailers that include side flaps (or "tabs") which are somehow removed when the two way mailer is opened are disclosed in U.S. Pat. Nos. 769,536 (Dixon); 1,960,054 (Johnson); and 4,487,360 (Fisher et al). None of these two way mailers, however, teach the concept of having the side flaps disengaged on edges while continuing to be attached to a surface of the two way mailer. In contrast, the present invention provides a two way mailer with vulnerable side flaps which are detached along edges of attachment, yet remain adhered to a panel which is to be discarded upon opening the forwarding envelope.

SUMMARY OF THE INVENTION

The present invention is directed to a novel and improved two way mailer which is more sturdy yet less expensive to manufacture than the two way mailers of the prior art.

More particularly, the two way mailer of the present invention includes a return envelope having a rear panel which also serves as the rear panel for the forwarding envelope. The return envelope is detachably secured to the forwarding envelope along panel and side flap perforated lines which are located exclusively or substantially exclusively in the common rear panel.

Following the opening of the front closure flap, the side flaps are separated from the rear panel along the side flap perforation lines, and remain adhered to the front panel of the forwarding envelope.

The front closure flap of the forwarding envelope is opened in a conventional manner, and the return envelope is readily separable from the front panel of the forwarding envelope, thus facilitating both access to the contents of the forwarding envelope, and subsequent use of the return envelope. Because the perforated lines are located exclusively or substantially exclusively in the rear panel, separation of the return envelope is effected without damage to any contents of the forwarding envelope.

These and other features and advantages of the present invention will become more apparent as the description proceeds with the aid of the accompanying drawings, wherein:

DETAILED DESCRIPTION

Figure 1:
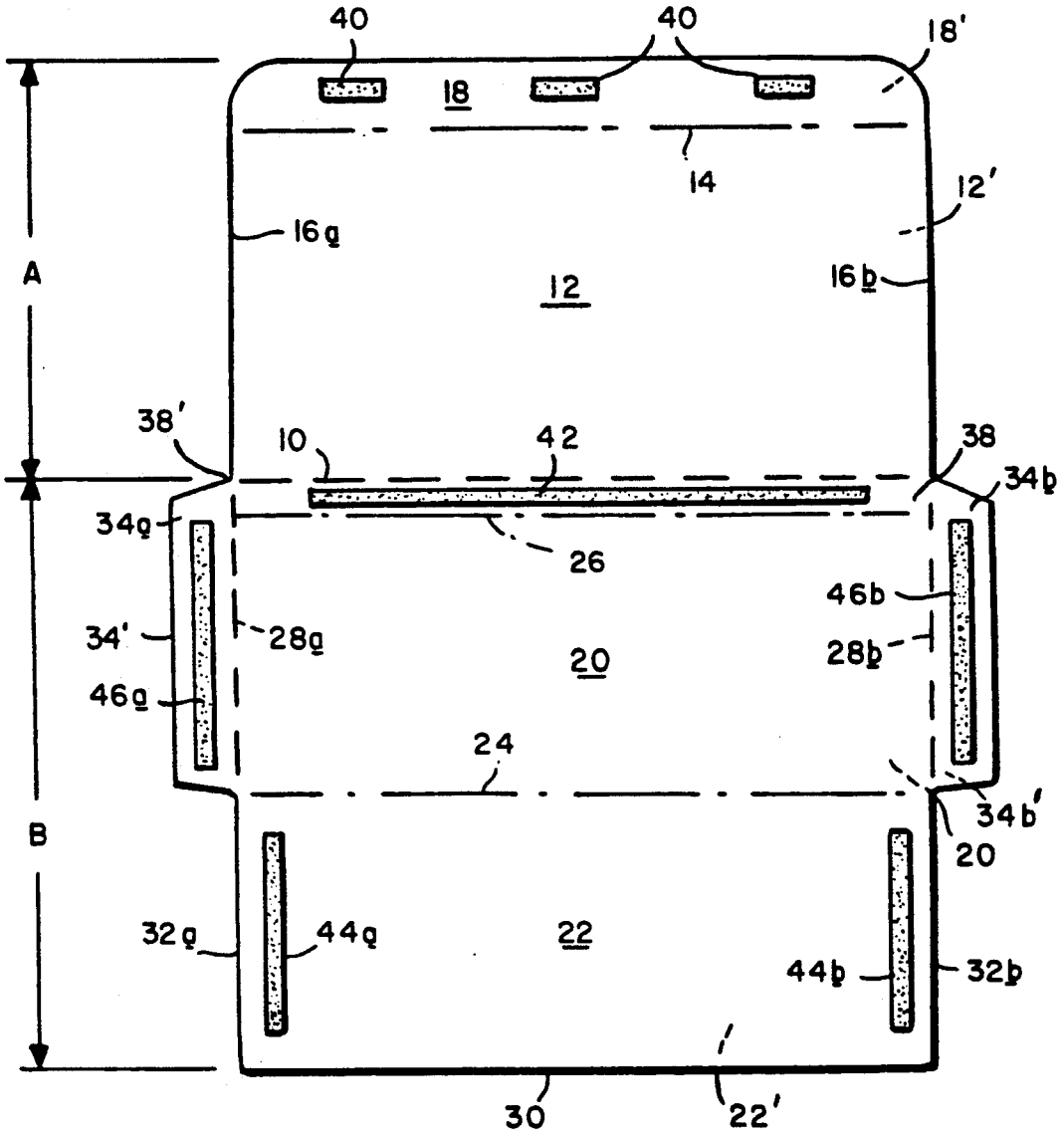
FIG. 1 is a plan view of a blank used to form one embodiment of the invention.

With reference initially to FIG. 1, a first embodiment of a two way mailer in accordance with the present invention is shown comprising a single blank of sheet material having first and second sections A, B separately interconnected at a panel perforated line 10. The first section A includes a front panel 12 having an outside face 12', a bottom edge coincident with the panel perforated line 10, a top edge 14 and side edges 16a, 16b. A front enclosure flap 18 having an outside face 18' extends outwardly from the top edge 14 of the front panel 12.

The second section B includes a rear panel 20 having an outside face 20', and a return panel 22 having an outside face 22', joined one to the other at a fold line 24. The rear panel has a top edge 26, a bottom edge coincident with the fold line 24, and perforated side edges 28a, 28b. The return panel 22 likewise has a bottom edge coincident with the fold line 24, a top edge 30, and side edges 32a, 32b.

Side flaps 34a, 34b having outside faces 34a', 34b', extend outwardly from and are detachably joined to the rear panel 20 at the perforated side edges 28a, 28b. The perforated side edges 28a, 28b are perpendicular to, and intersect with, the panel perforated line 10. In order to insure that a clean corner is created during separation along the panel and side flap perforated lines, there may be some minute "bleed over" of the side flap perforated lines across the panel perforated line. Practically speaking, however, and regardless of whether bleed over occurs, the side flap perforated lines 28a, 28b are located substantially exclusively in the rear panel 20, i.e., in the second section B. The fold line 24 and the top edges 26, 30 are parallel to the panel perforated line 10.

A return closure flap 38 having outside face 38', extends outwardly from the top edge 26 of the rear panel 20. The return closure flap 38 is detachably joined to the front panel 12 at the panel perforated line 10.

A first adhesive means comprising glue lines 44a, 44b is provided on the return panel 22. A second adhesive means comprises glue lines 46a, 46b on the side flaps 34a, 34b respectively. A third adhesive means comprising glue spots 40 is provided on the front enclosure flap 18. A fourth adhesive means includes glue line 42 which is provided on return closure flap 38.

Figure 2:
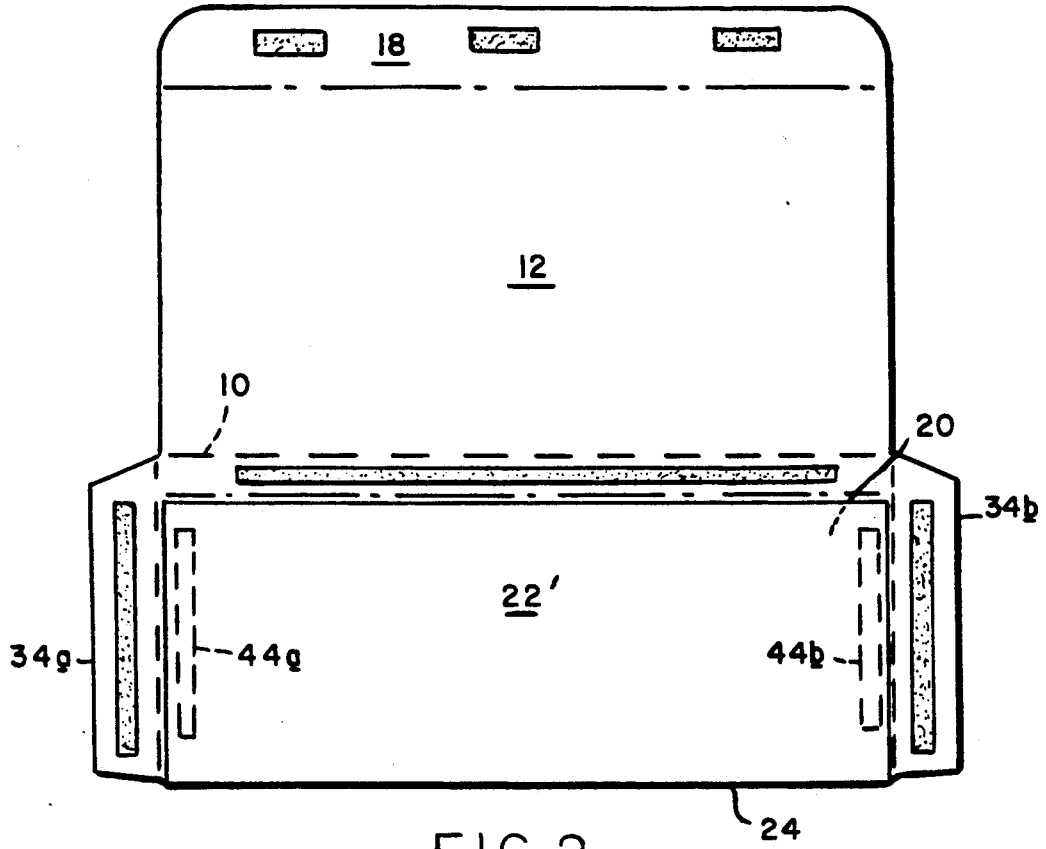
FIGS. 2–5 are views showing the sequential steps followed to form a two way mailer from the blank shown in FIG. 1.

The blank illustrated in FIG. 1 is formed into a two way mailer in the following manner: as illustrated in FIG. 2, the return panel 22 is folded about the fold line 24 onto the rear panel 20, and is adhered to the rear panel 20 by means of the glue lines 44a, 44b. FIG. 2 illustrates the outside face 22' of the return panel 22.

Figure 3:
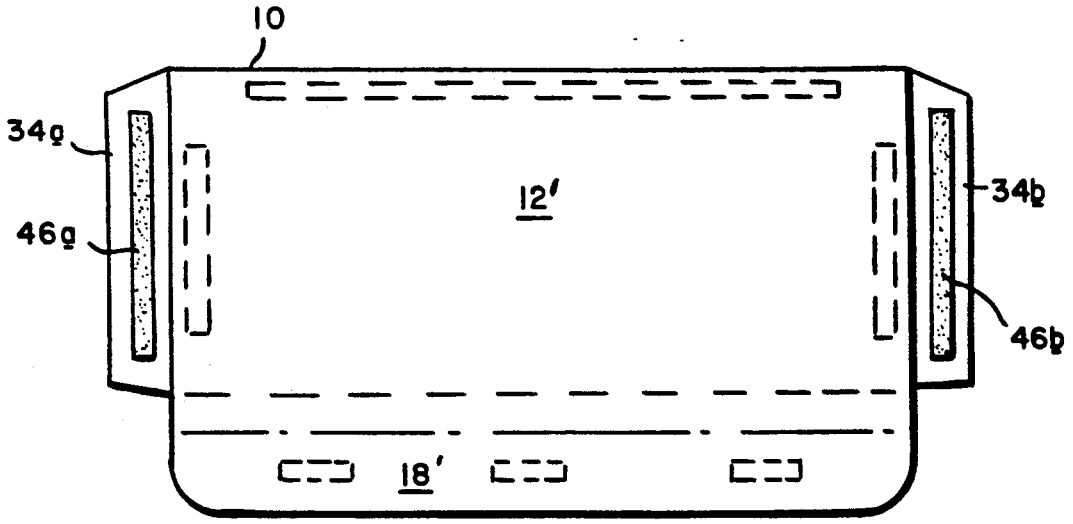
Figure 4:
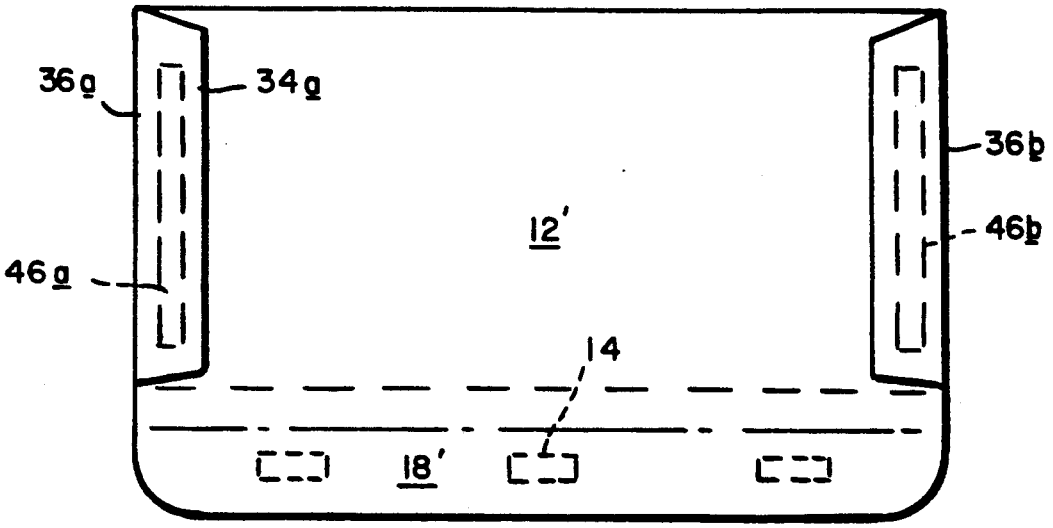
Figure 5:
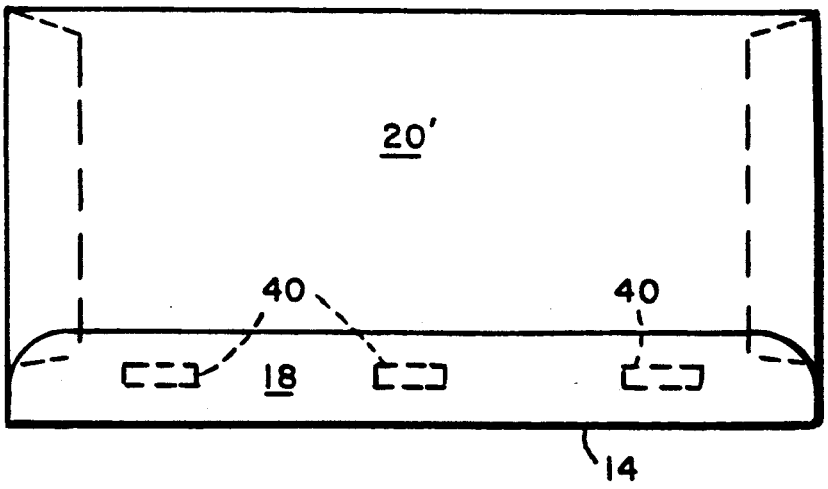

Next, as shown in FIG. 3, the front panel 12 is folded about the panel perforation line 10 onto the previously inwardly folded return panel 22 The side flaps 34a, 34b are then folded about the side flap perforated lines 28a, 28b respectively as shown in FIG. 4. The side flaps 34a, 34b are adhered to the outside face 12' of the front panel 12 by means of the glue lines 46a, 46b respectively to thereby form the forwarding envelope. After the forwarding envelope has been turned over and stuffed, the front enclosure flap 18 is folded about the top edge 14 of the front panel 12 onto the outside face 20' of the rear panel 20, as shown in FIG. 5. The front enclosure flap 18 is adhered to the outside face 20' of the rear panel 20 by means of the glue spots 40, thus sealing the forwarding envelope. The recipient's address may be printed on the outside face 12' of the front panel 12 of the forwarding envelope.

Figure 6:
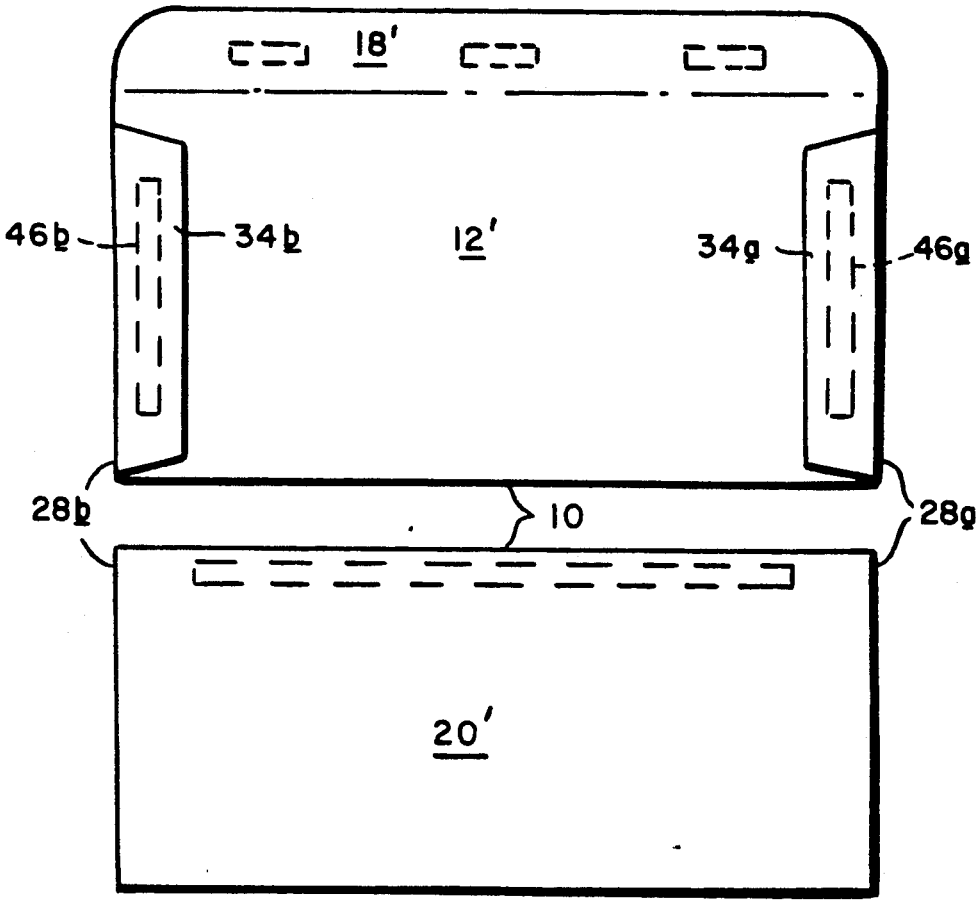
FIG. 6 is a view showing a return envelope following its separation from the two way mailer formed from the blank shown in FIG. 1.

As can be seen by reference to FIG. 6, the recipient may gain access to the contents of the forwarding envelope by simply peeling open the front enclosure flap 18, and tearing the front panel 12 along the panel perforation line 10 and the side flap perforation lines 28a, 28b. The side flaps 34a, 34b detach along the side flap perforation lines 28a, 28b, and remain adhered to the thus detached front panel 12 by means of the glue lines 46a, 46b. This unique concept provides for a novel two way mailer which combines efficiency in that it conserves material, yet provides for a secure forwarding envelope and a large return envelope.

Figure 7:
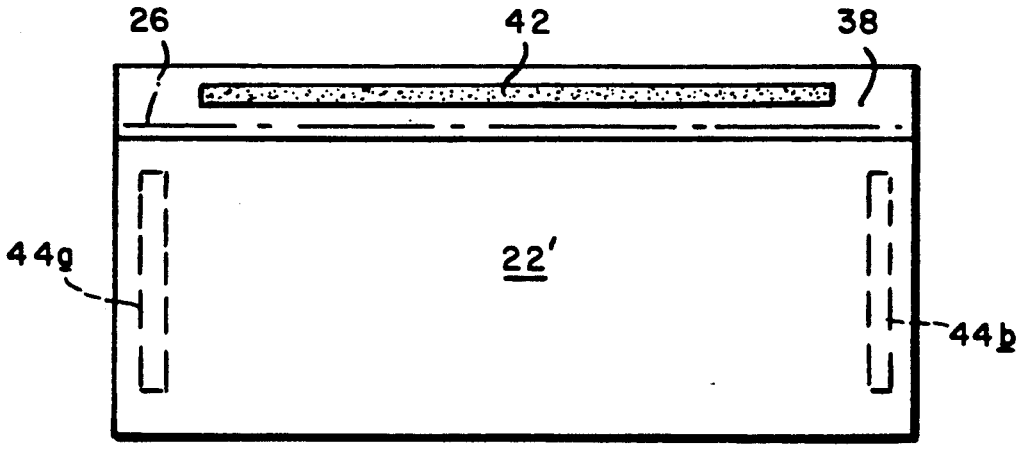
FIGS. 7–8 are views showing the sequential steps followed to form a return envelope from the two way mailer formed from the blank shown in FIG. 1.
Figure 8:
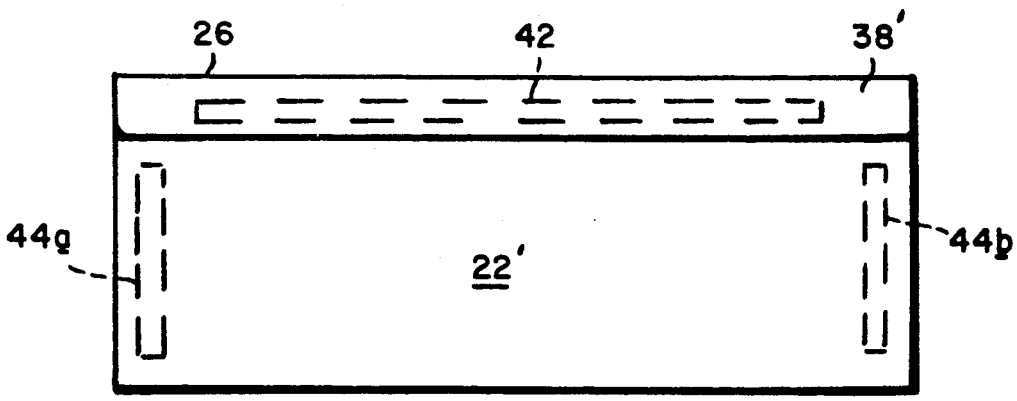

The rear panel 20 and the return panel 22 remain adhered to one another by means of the glue lines 44a, 44b, thus forming the return envelope as shown in FIG. 7. After the return envelope is stuffed, it may be closed by folding the return closure flap 38 along the top edge 26 of the rear panel 20 as shown in FIG. 8. The return closure flap 38 is adhered to the outside face 22' of the return panel 22 by means of the glue line 42, thus sealing the return envelope.

Notice that the outside widths of both the forwarding and return envelopes are substantially equal. This is because they share common perforated lines 29a, 28b. In the preferred embodiment, the width is designed such that the two way mailer meets the approval of postal authorities for automatic handling.

Figure 9:
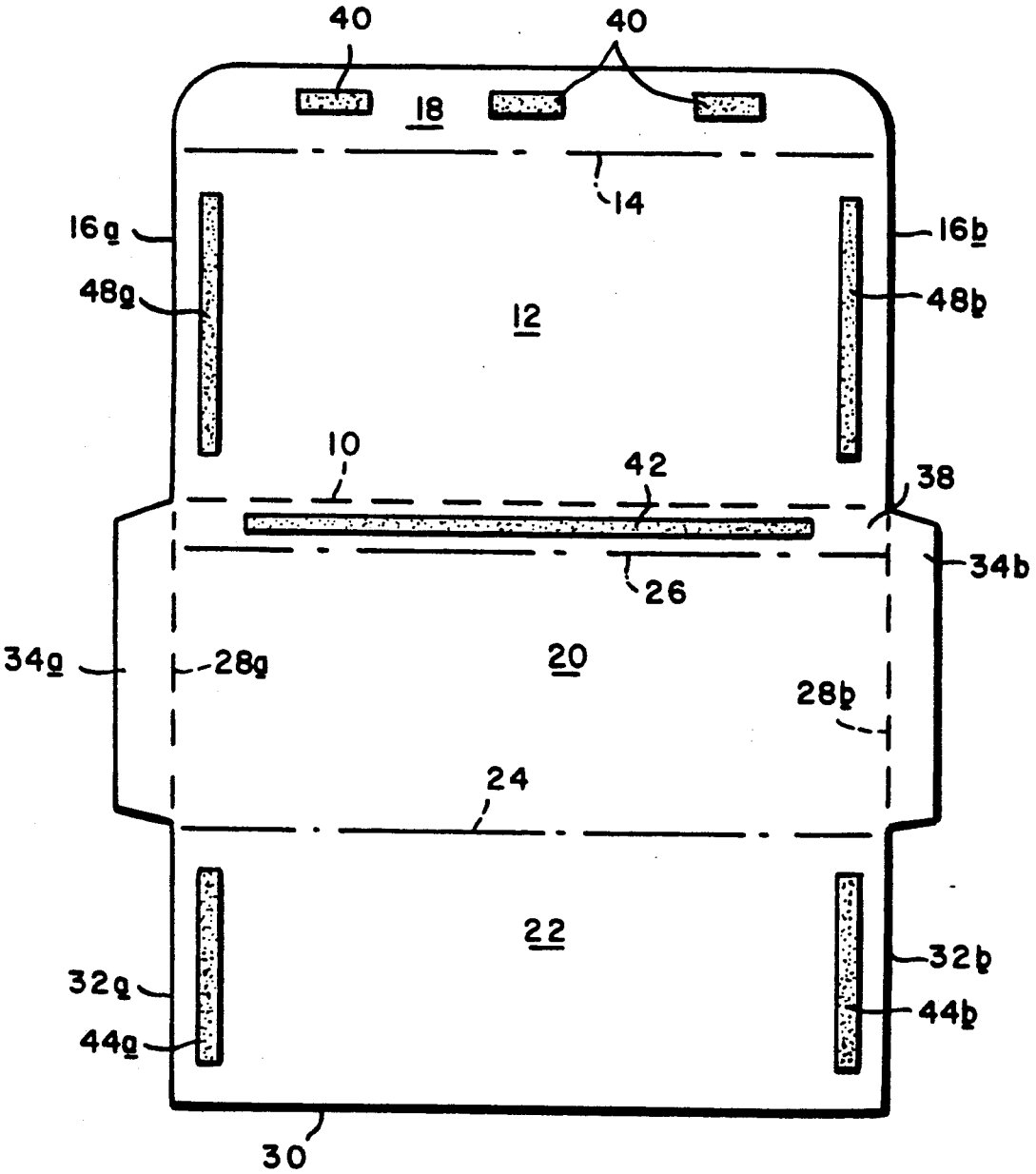
FIG. 9 is a plan view of a blank used to form a second embodiment of the invention.

A second embodiment of a two way mailer in accordance with the present invention is shown in FIGS. 9 to 14. Referring to FIG. 9, it will be seen that the second embodiment is similar to the first embodiment of FIG. 1, except with regard to the second adhesive means which comprises glue lines 48a, 48b provided on the front panel 12. Conversely, the second adhesive means of the first embodiment comprises glue lines provided on the side flaps 34a, 34b.

Figure 10:
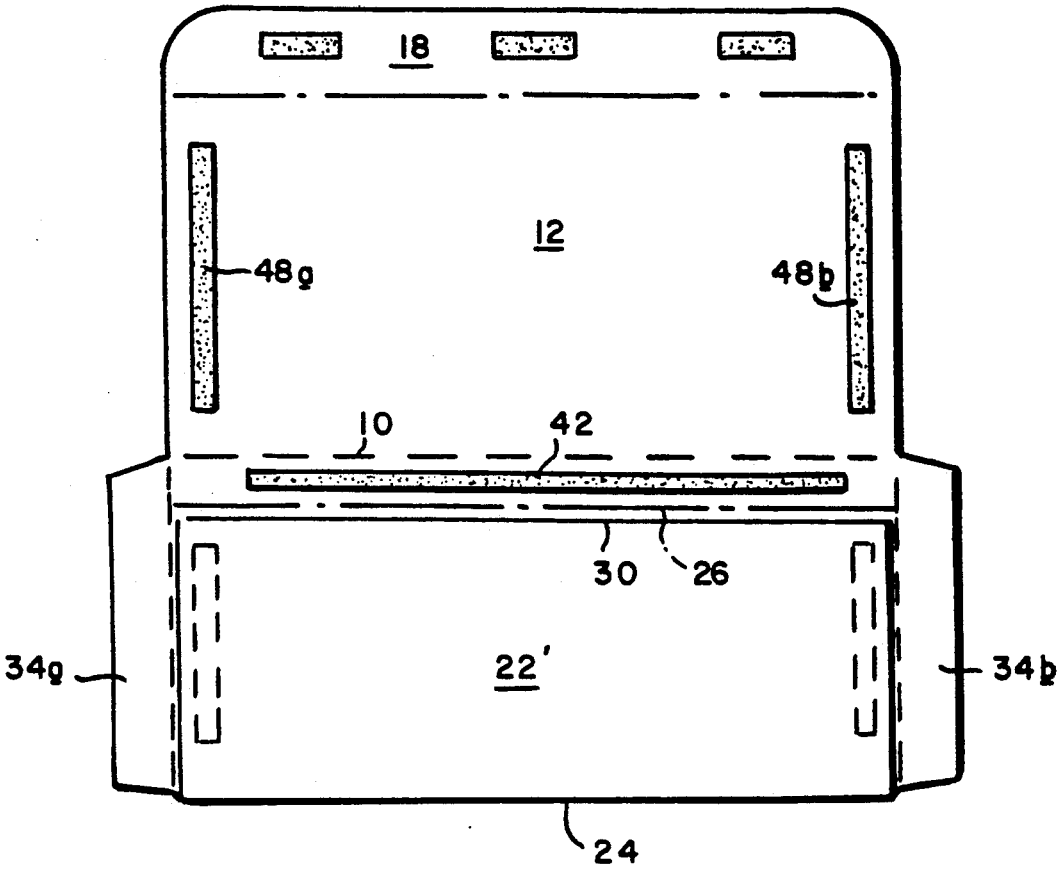
FIGS. 10–13 are views showing the sequential steps followed to form a two way mailer from the blank shown in FIG. 9.
Figure 11:
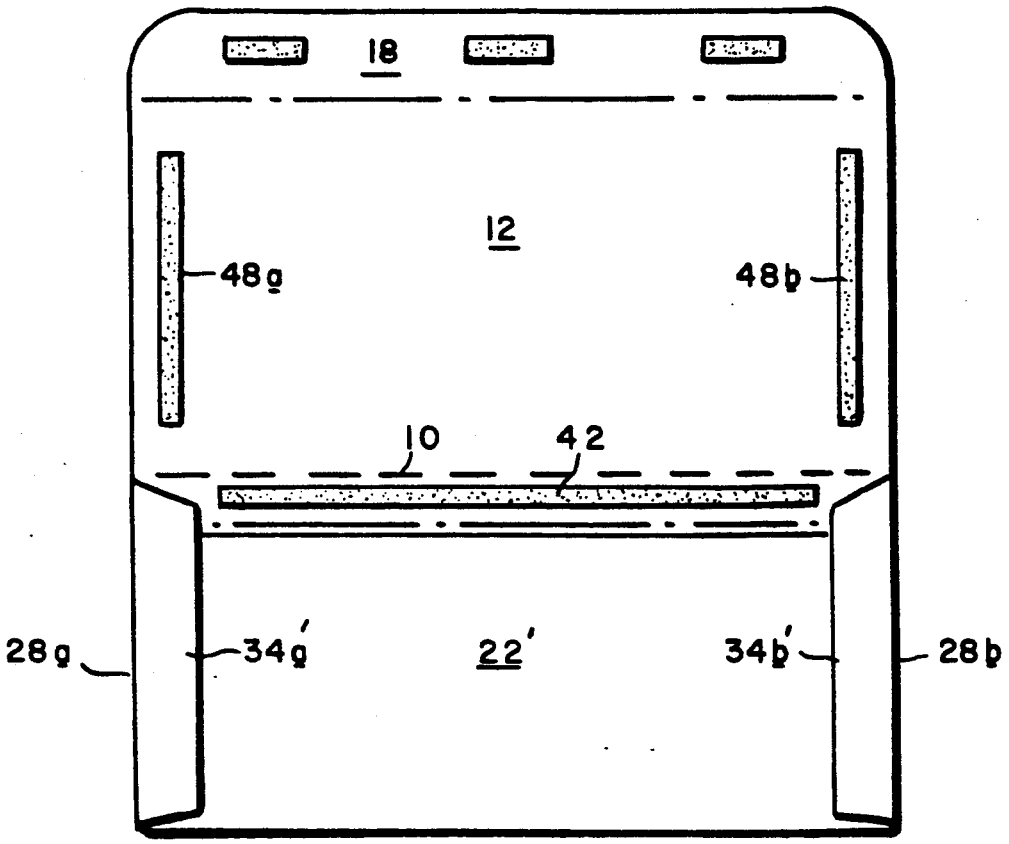

The procedure for forming the second embodiment into a two way mailer is as follows: as shown in FIG. 10, the return panel 22 is folded about fold line 24 onto the rear panel 20, and the two panels are adhered together by the glue lines 44a, 44b, thus forming the return envelope. As shown in FIG. 11, the side flaps 34a, 34b are then folded about the side flap perforation lines 28a, 28b onto but are not adhered to the outside face 22' of the return panel 22.

Figure 12:
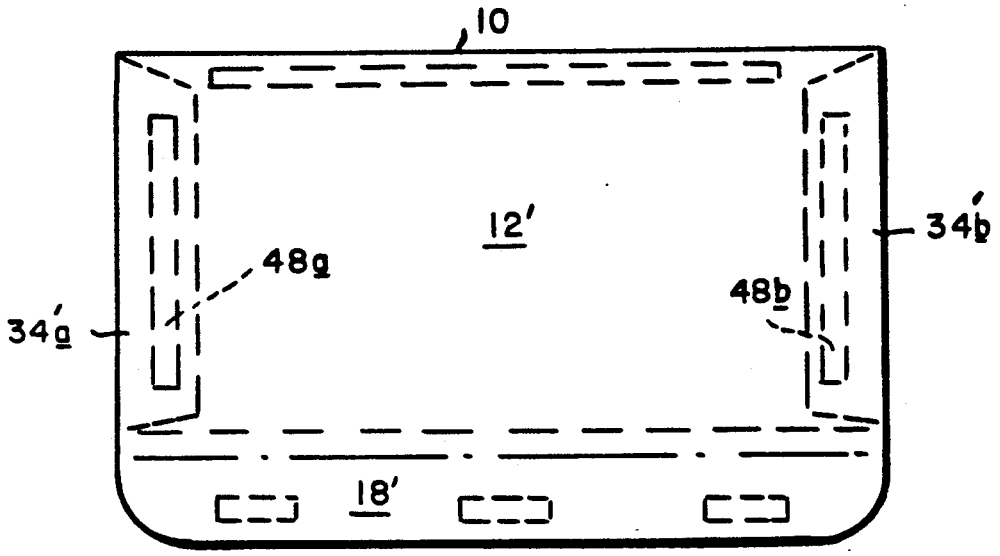
Figure 13:
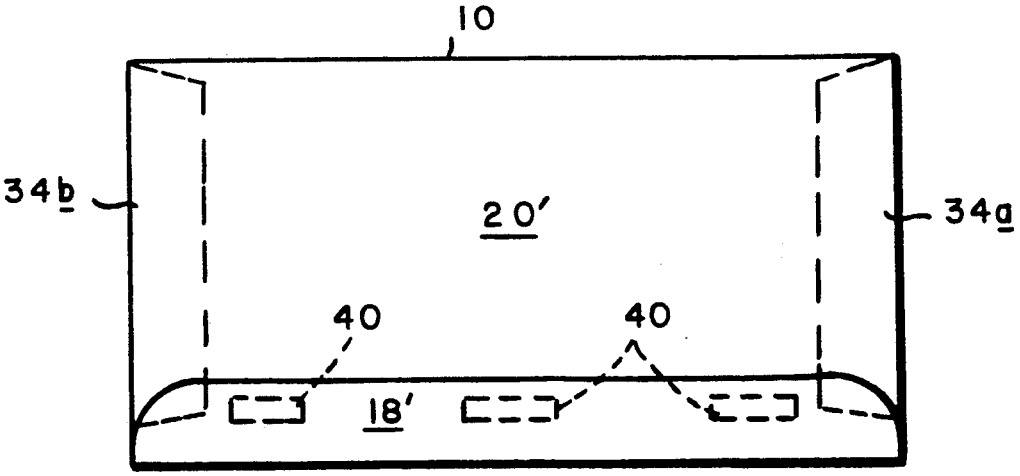

Next, as shown in FIG. 12, the front panel 12 is folded about panel perforated line 10 onto the outside faces 34a', 34b, of the thus folded side flaps 34a, 34b, and the outside face 22' of the thus folded return panel 22. The front panel 12 is adhered to the outside faces 34a', 34b, at the thus folded side flaps 34a, 34b by means of the glue lines 48a, 48b. Finally, the front enclosure flap 18 is folded about the top edge 14 of the front panel 12 onto the outside face 20' of the rear panel 20' as shown in FIG. 13. Front panel 12 is adhered to the outside face 20' of the rear panel 20 by means of the glue spots 40, thus sealing the forwarding envelope.

Figure 14:
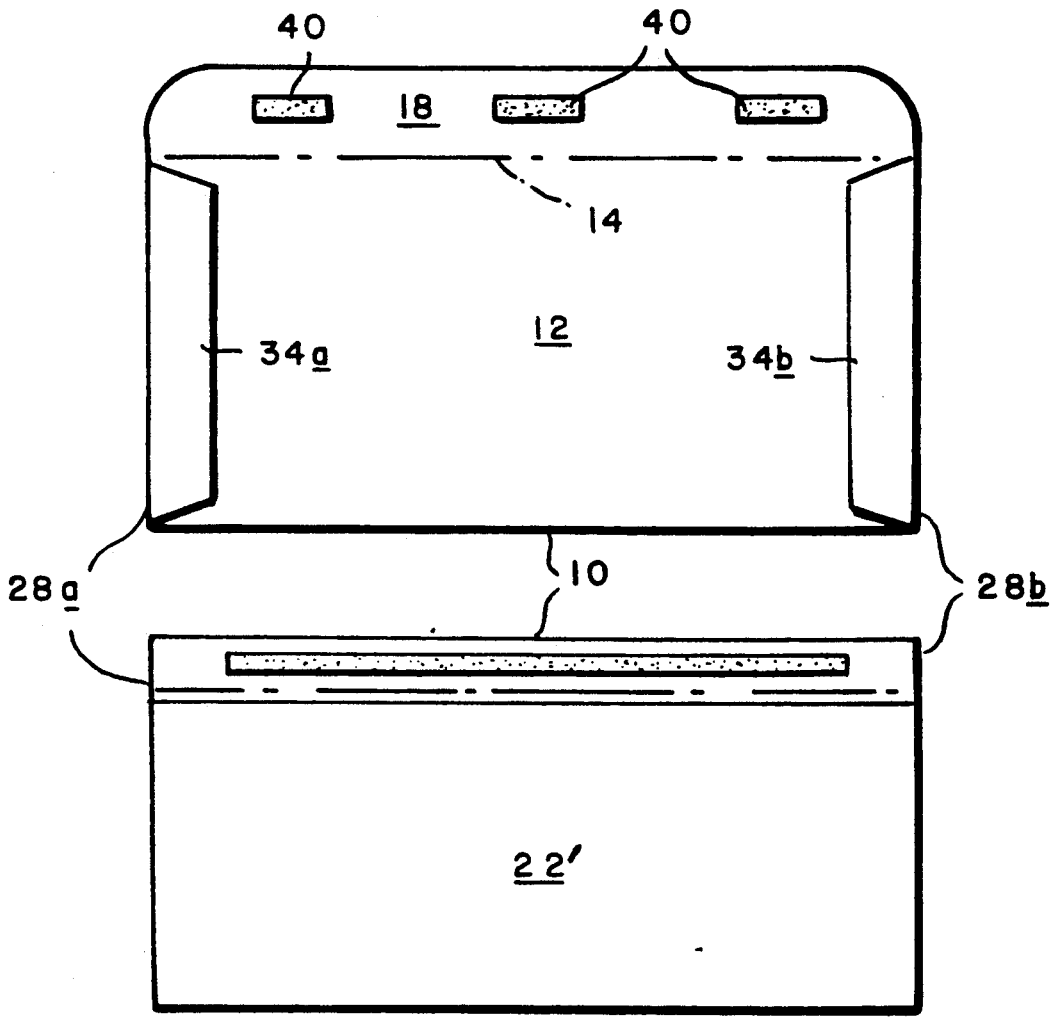
FIG. 14 is a view showing a return envelope following its separation from the two way mailer formed from the blank shown in FIG. 9.

Access to the contents of the forwarding envelope is again provided by simply peeling open the front enclosure flap 18, and tearing the front panel 12 along the panel perforation line 10 and the side flap perforation lines 28a, 28b. As shown in FIG. 14, the side flaps 34a, 34b detach along the side flap perforation lines 28a, 28b, and remain adhered to the thus detached front panel 12 by means of the glue lines 48a, 48b.

Similar to the first embodiment, the return envelope remains formed from the rear panel 20 adhered to the return panel 22 by means of the glue lines 44a, 44b. As detailed above, the return envelope may be closed by folding the return closure flap 38 along the top edge 26 of the rear panel 20 as shown in FIG. 8. The return closure flap 38 is adhered to the outside face 22' of the return panel 22 by means of the glue line 42, thus sealing the return envelope.

Figure 15:
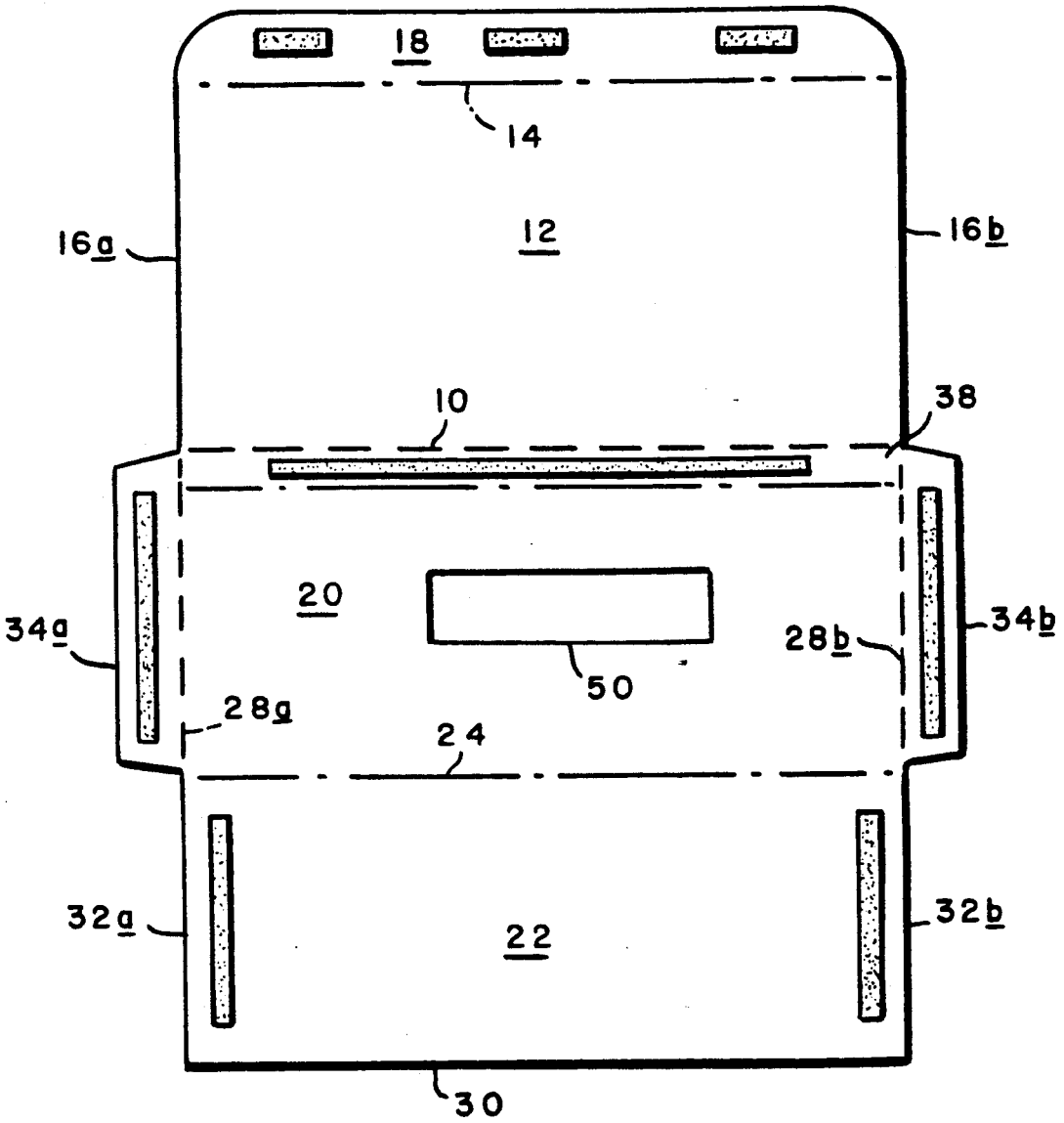
FIG. 15 is a plan view of a blank shown in FIG. 1 with a window for forming a two way mailer of the present invention which includes a window.
Figure 16:
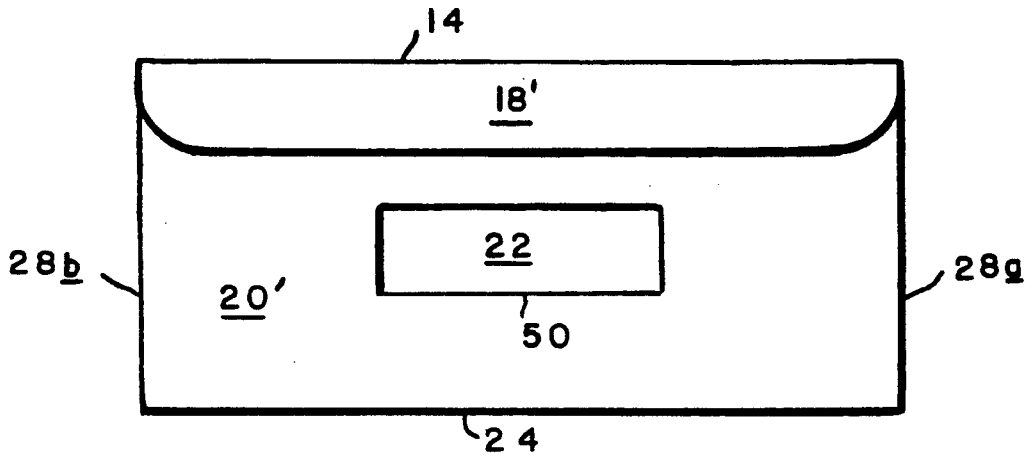
FIG. 16 is a view of the back of the forwarding envelope formed from the blank shown in FIG. 15.
Figure 17:
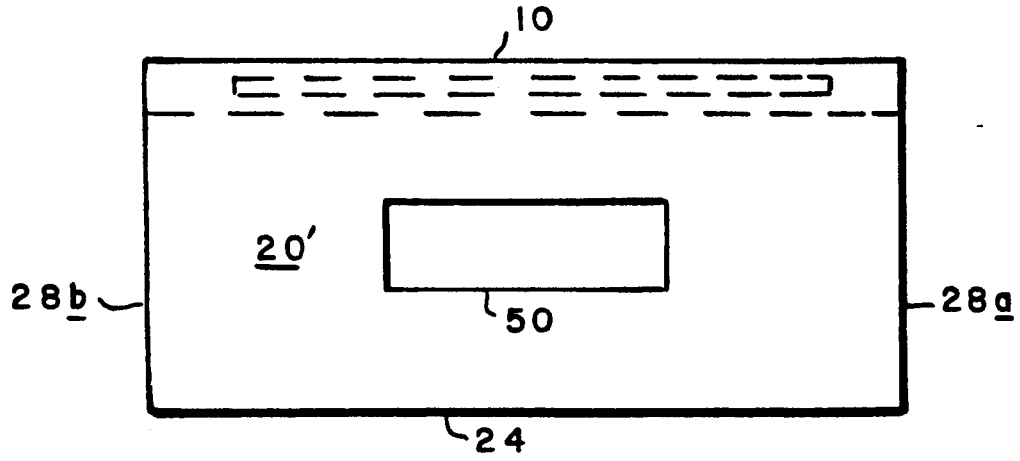
FIG. 17 is a view of the front of the return envelope formed from the blank shown in FIG. 15.

It will be appreciated that additions and variations ma be made to either of the above illustrative embodiments without departing from the scope of the invention. For example, as shown in FIGS. 15 to 17, the two way mailer might further include a window 50 within the rear panel 20. The address for the return envelope could be printed on the inside face of the return panel 22 such that the address would be visible through the window 50 when the two way mailer is formed. As shown in FIG. 16, this would not interfere with the front of the forwarding envelope because the window 50 would be on the back side of the forwarding envelope. Moreover, material could be placed within the forwarding envelope such that the return address printed on the inside face return panel 22 would not be visible through the window 50. The front side of the return envelope would consequently include the window 50. The sending address for the return envelope would be visible through the window 50 as printed on the inside face of the return panel 22.

Other variations in the above could include altering the placement of the various glue lines such that the resulting adhesion upon formation of the two way mailer, remains unchanged. For example, the third adhesive means might include the glue lines 44*a*, 44*b* located on the rear panel 20 instead of the return panel 22 such that upon folding the return panel 22 onto the rear panel 20, a similar return envelope is formed.

I claim:

1. A two way mailer formed of a single blank of sheet material, comprising:

first and second sections;

means including a first perforated line for separably interconnecting said first and second sections; said first section including a front panel having an inside face and an outside face, and having bottom, top and side edges, with a front enclosure flap extending outwardly from the top edge of said front panel;

said second section including rear and return panels, each having bottom, top and side edges, with a return closure flap extending outwardly from the top edge of one of said rear or return panels, and with second perforated lines located substantially exclusively in said second section, said second perforated liens being perpendicular to said first perforated line and being spaced inwardly from and parallel to the side edges of said rear panel to thereby define side flaps extending outwardly from the side edges of said rear panel, said second perforated lines being substantially coincident with said side edges of said first section, the bottom edges of said rear and return panel coincidentally defining a fold line parallel to said first perforated line and about which said return panel is foldable onto said rear panel;

first means for adhering the return panel to said rear panel at locations inside of said perforated lines to thereby form a return envelope, the return envelope being foldable about said first perforated line onto said inside face of said front panel;

second means for adhering the side flaps of the return envelope to said front panel;

third means for securing the front closure flap to said rear panel, whereupon following opening said front closure flap, said return envelope is separable from said front panel along said first and second perforated lines, with said return flap being foldable to close the return envelope; and fourth means for securing the return flap in the closed position.

2. The two way mailer of claim 1, wherein said side flaps of the folded return envelope are adhered to said inside face of said front panel.

3. The two way mailer of claim 2, wherein said second means is located on the inside face of said front panel.

4. The two way mailer of claim 2, wherein said second means is located on said side flaps.

5. The two way mailer of claim 1, wherein said side flaps of the folded return envelope are adhered to said outside face of said front panel.

6. The two way mailer of claim 2, wherein said second means is located on the outside face of said front panel.

7. The two way mailer of claim 2, wherein said second means is located on said side flaps.

8. The two way mailer of claim 1, wherein said rear panel further includes a window such that materials behind said rear panel may be exposed through said window.

* * * * *